United States Patent [19]

Silbernagel

[11] 4,121,070

[45] Oct. 17, 1978

[54] ENCLOSED PUSH BUTTON TYPE SWITCH

[75] Inventor: John P. Silbernagel, Crystal, Minn.

[73] Assignee: Renal Systems, Inc., Minneapolis, Minn.

[21] Appl. No.: 774,249

[22] Filed: Mar. 4, 1977

[51] Int. Cl.[2] ..... H01H 9/04

[52] U.S. Cl. ..... 20/67 DB; 200/159 B; 200/302

[58] Field of Search ..... 200/302, 159 B, 159 A, 200/159 R, 275, 67 D, 67 DB, 86 R

[56] References Cited

U.S. PATENT DOCUMENTS

| | | | |
|---|---|---|---|
| 1,928,472 | 9/1933 | Wilcox | 200/86 R |
| 2,229,585 | 1/1941 | Osenberg | 200/275 |
| 2,516,584 | 7/1950 | Parr | 200/302 |
| 2,812,402 | 11/1957 | Dixon | 200/302 |
| 3,246,112 | 4/1966 | Adams | 200/302 |
| 3,389,902 | 6/1968 | Young | 200/67 D |
| 3,996,428 | 12/1976 | Buan | 200/159 B |
| 4,021,630 | 5/1977 | Taylor | 200/302 |
| 4,056,700 | 11/1977 | Stannek | 200/67 DG |

*Primary Examiner*—S. Clement Swisher
*Assistant Examiner*—Denis E. Corr
*Attorney, Agent, or Firm*—Irving S. Rappaport

[57] ABSTRACT

An enclosed push button switch in which movable and fixed contact members are mounted on the switch frame, the assembly being enclosed by a protective covering which is deformable on the upper surface thereof and in contact with the movable contact member of the switch to permit operation of the same through the cover.

10 Claims, 5 Drawing Figures

ENCLOSED PUSH BUTTON TYPE SWITCH

My invention relates to a push button type switch and more particularly to an improved emclosed push button type switch particularly adapted for use in a corrosive environment.

BACKGROUND OF INVENTION

Where switches are adapted for use in corrosive environments, the switch contacts are normally enclosed or sealed from the environment and an external operator is used for manipulating or operating the same. Such switches have employed external magnets as a means for influencing operation of the switch parts within an enclosure. However, these arrangements have required special mounting of parts, enclosures, and special mounting of the external operator and sealing of the same. Such parts themselves are subject to corrosion and undue wear and increases the cost of the switch.

SUMMARY OF INVENTION

The improved push button type switch of the present invention is particularly adapted for use in a corrosive atmosphere, such as a portable conductivity meter, for use with an artificial kidney machine such as is shown in the U.S. Pat. of Stuart L. Gallant and Louis C. Consentino, Pat. No. 3,980,944. In the use of the portable conductivity meter, a probe is adapted to be inserted into a dialysate solution to determine conductivity of the same, and a switch is utilized for energizing the meter from an enclosed battery source.

The dialysate solution includes ion constituents which readily induces corrosion that attacks the switch parts. In the present invention, an improved enclosed push button switch is utilized in which the movable switch parts are mounted on a frame of electrically insulated material and the switch parts are enclosed by a covering of a polyvinyl chloride or plastic with the top of the cover being deformable to allow relative movement of the switch parts within the enclosure. The covering material protects the switch parts from the corrosive environment The switch includes conventional snap action switch parts which are mounted on and sealed into the frame and enclosed by the cover to provide an arrangement in which the presence of dialysate solution on the switch cover will not adversely effect the moving switch parts. Thus, the improved enclosed push button switch provides an arrangement in which no exposed switch parts are present to the corrosive environment inasmuch as a protective covering surrounds the same with the covering being deformable to allow for switch operation by depression of the same.

BRIEF DESCRIPTION OF THE DRAWINGS

The improved switch is shown in the preferred embodiment in the attached drawings, wherein.

DESCRIPTION OF THE PREFERRED EMBODIMENT

Figure 1:
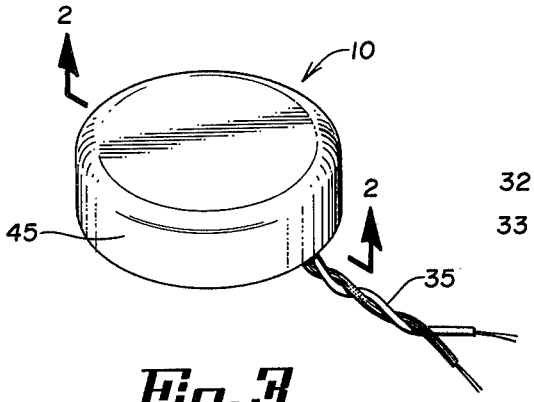
FIG. 1 is a perspective view of the enclosed push button type switch of the present invention.
Figure 2:
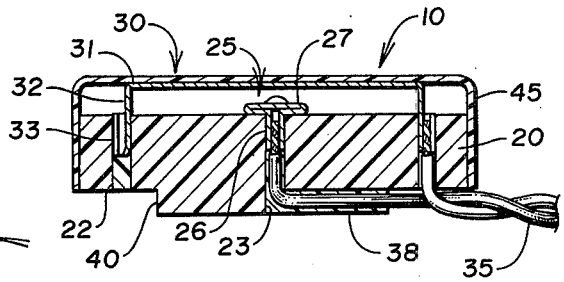
FIG. 2 is a sectional view of the same taken along the lines 2—2 in FIG. 1.
Figure 3:
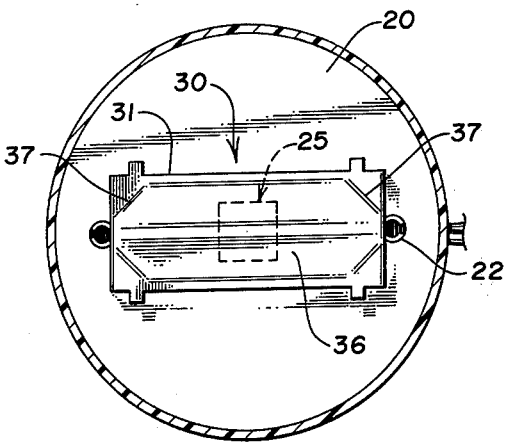
FIG. 3 is plan view of the switch with a portion of the cover removed.
Figure 4:
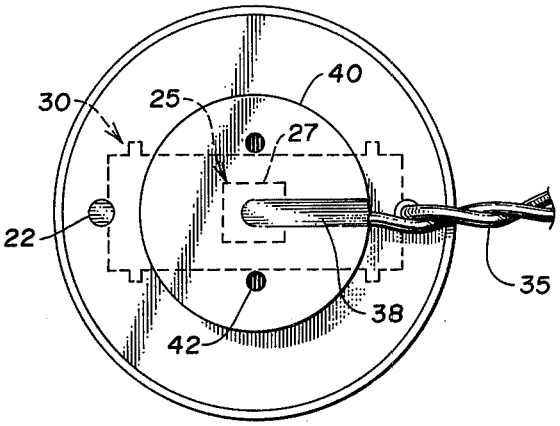
FIG. 4 is a bottom view of the enclosed push button type switch.

The improved push button switch is shown generally at 10 in FIG. 1. It includes a base frame or base member 20 which is generally cylindrical in form and is made of a suitable plastic material having good electrical insulating characteristics. A plurality of mounting holes 22, 23 are positioned through the base frame 20 extending from one surface to the other with the mounting hole 23 being located at the geometrical center of the cylindrical frame and the mounting holes 22 being positioned in general alignment therewith across the diameter of the frame and equally spaced from hole 23.

A fixed contact member 25 is positioned in the mounting hole 23 which has a lead wire mounting clip portion 26 extending from a square head portion 27. The mounting clip portion 26 is positioned in the aperture 23 to mount the fixed contact member 25 and connect a lead wire thereto which extends through the aperture 23 from the surface opposite that where the head portion 27 is positioned. The fixed contact member is preferably made of a good conductive material such as silver or gold. Also positioned on this surface of the base frame 20 is a movable contact member 30 which has a generally rectangular or flat plate portion 31 with bent flanges 32 at the ends of the same and lead clip portions 33 extending from the flanges and centrally located within the flanges. The movable contact member 30 is mounted in the base frame through lead clip portions 33 which extend through the apertures 22 in the base frame, permitting a lead wire connection through the body from the surface opposite that which the movable contact member is mounted. Suitable lead wires, indicated generally at 35, connect respectively to the movable and fixed contacts 25 and 30 respectively to provide the electrical circuit thereto. One lead wire 35 extends through an aperture 22 in the base frame and is connected to a lead clip portion 33 for the movable contact. Another lead wire 35 extends through a slot 38 in the base frame 20 leading to the aperture 23 and is connected to the clip portion 26 of the fixed contact 25. The apertures 22, 23 are then suitably sealed with a suitable sealing material to prevent penetration of moisture to the lead wire clip portions and the surface of the base frame upon which the contact members 25, 30 are mounted.

The bottom of the base frame 20 has a shoulder portion 40 in which the slot 38 leading to the centrally located aperture 23 is positioned. In addition, a pair of additional mounting holes 42 are positioned in the bottom of base frame. These holes projecting partially into but not through the base frame 20.

The switch 10 is basically a snap action switch and the movable contact member 30 with its generally flat rectangular frame has a convex center portion 36 with a suitable bend creases 37 in the edges of the same enabling the generally flat extent, when depressed, to snap toward the fixed contact 25 to make an electrical circuit therebetween.

The switch 10 includes a molded cover member 45 which is generally cup-shaped in form and which is designed to fit over the contacts on the surface of the base member 20 and slidably fit over the cylindrical side surface of the base frame. The cover 45 has a depth or height sufficient to fit down over the cylindrical side surface on the base member with sufficient height to be positioned adjacent and in substantial contact with the surface of the movable contact member 30 mounted on the base frame 20. The cover member is made of a polyvinyl chloride material and the top adjacent the movable contact member is deformable when pressure is applied thereto. Movement of the same will cause movement of the movable contact member 30 to flex and move the same to an overcenter position causing a snap action or movement of the same into contact with fixed contact 25. As long as pressure is maintained on the cover 45, the switch will be in a made or closed position and whenever pressure is released, the movable contact member 30 will snap back to its original form separating from the fixed contact 25. The cover member is secured to the sides of the base member through a corrosion resistant adhesive. An adhesive, such as "Super Bond 416 Adhesive" manufactured by Locktite Corporation of Millington, Conn. is suitable for this purpose.

The polyvinyl chloride cover which fits down over the base member is corrosion resistent and seals the switch contacts on the frame to prevent exposure of a corrosive environment thereto. Similarly, the apertures 22, 23 in the base of the frame member are sealed with a material which is corrosion resistant, and like the material of the base member, positively seals and encloses the switch.

Figure 5:
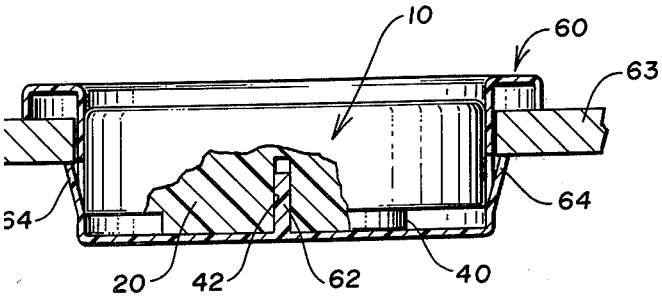
FIG. 5 is an elevation view of the switch and a mounting means for the same.

As shown in FIG. 5, the improved switch is adapted to be mounted into a switch mounting member 60 fitted through an aperture in a supporting plate 63. The mounting member has suitable flanges adapted to rest on the side of the supporting plate 63. The flanges extend to a cup shaped portion which conforms to the sides and bottom of the switch member 10. Suitable prongs 62 in the mounting member fit into the mounting apertures 42 of the base frame 20 of the switch to positively secure the same against rotation. The mounting member 60 includes mounting clips 64 which bear against the under surface of the plate 63 to secure the mounting member 60 therein. The push button switch will be located in the mounting member and secured therein with the lead wires 35 being drawn out through an aperture (not shown) in the mounting member.

The improved push button switch provides an enclosed structure for the contact members positively sealing the same against any corrosive environment. The protective cover over the switch is deformable on its upper surface and in contact with the movable contact portion of the switch under the cover so that depression of the same will operate the switch through the cover. The materials involved in the base frame, in the cover and in the adhesive sealing the lead mounting and connecting apertures therein, are such to prevent the corrosive environment from reaching the switch parts or effecting the supporting and enclosing portions of the same. The improved enclosed push button switch is particularly adaptable for use in an corrosive environment where the presence of corrosive solutions, such as a dialysate solution, would come in contact with the same.

Therefore, before considering this invention, it should be remembered that the present disclosure is illustrative only and the scope of the invention should be determined by the appended claims.

I claim:

1. A single enclosed, sealed push button switch comprising:

a base frame having top and bottom surfaces and having a plurality of mounting holes therein substantially perpendicular to said top and bottom surfaces;

a centrally located contact member having connector means mounted in one of said holes with a contact member projecting from the top surface of said base frame;

a second contact member having connector means and overlying the first named contact member and having a substantially flat upper surface, said second contact member having flanges extending normal to the flat surface to space the flat surface from the first contact member;

connector means included in said flanges projecting through other of said holes in said base frame for mounting said second contact member on said base frame;

lead wires extended substantially perpendicular to the bottom surface of said base frame through said mounting holes and connected to said connector means of said contact members;

corrosion-resistant sealing means sealing said mounting holes through which said lead wires extend; and corrosion-resistant enclosure means fitted over and substantially conforming in shape with said base frame and enclosing said contact members, said enclosure means being flexible on the surface adjacent said contact members to enable depression of the same to move said second contact member into engagement with the first named contact member, said enclosure means being bonded through a corrosion-resistant adhesive to said base frame to completely hermetically seal the entire switch thereby preventing the entry of any moisture and corrosive debris from entering the switch to cause malfunctioning of said switch.

2. The enclosed push button type switch of claim 1 in which the base frame is a cylindrical member of good electrical insulating material.

3. The enclosed push button type switch of claim 2 in which the base frame includes means on the surface opposite the location of the contact members means for mounting the switch.

4. The enclosed push button switch of claim 2 in which the flat surface of the second contact member is deformable for an overcenter action when depressed to snap the second contact member into engagement with the first contact member.

5. The enclosed push button switch of claim 1 in which the first contact member includes a flat surface of a good electrical conductive material and said connector means includes a mounting and lead wire clip extending therefrom positioned through a centrally located hole in said base member, said lead wire clip gripping and providing good electrical contact with said lead wire connected thereto and in which said second contact member is generally rectangular in shape with the flat surface having bend creases continuously around the edges thereof forming a generally convex center portion adapted to impart an over center action to said contact members.

6. The enclosed push button switch of claim 5 in which the second contact member is made of berylium copper with the flange means having projections spacing the flat surface from said base member and with mounting lead wire clip portions extending from the flanges thereof through apertures in said base frame mounting said second contact member therein and for gripping and providing good electrical contact with said lead wire connected thereto.

7. The enclosed push button type switch of claim 2 in which the enclosure means is cover member made of a polyvinyl chloride material which is molded to conform to the sides of said cylindrical base frame and to be suitably bonded thereto with a corrosion-resistant adhesive.

8. The enclosed push button switch of claim 1 in which the enclosure means is made of polyvinyl chloride material which is disposed adjacent to and substantially in contact with the second contact member and is deformable to deform the second contact member enclosed thereby when depressed.

9. The enclosed push button switch of claim 3 wherein said means for mounting the switch includes at least one of said other mounting holes being unsealed and located in the bottom surface of said base frame and extending partially into but not completely through said base frame and adapted for mounting the entire switch to a mounting member.

10. The enclosed push button switch of claim 1 wherein said base frame further includes a shoulder extending from said bottom surface thereof, said shoulder having a slot defined therein communicating with the mounting hole through which said lead wire connected to said first contact member extends, said slot being provided to contain and protect said lead wire connected to said first contact member.

* * * * *